US005154732A

United States Patent [19]

Hakulin et al.

[11] Patent Number: 5,154,732

[45] Date of Patent: Oct. 13, 1992

[54] APPARATUS FOR GASIFYING OR COMBUSTING SOLID CARBONACEOUS

[75] Inventors: Bertel K. Hakulin, Helsinki; Jorma J. Nieminen, Varkaus, both of Finland

[73] Assignee: A. Ahlstrom Corporation, Karhula, Finland

[21] Appl. No.: 463,462

[22] Filed: Jan. 11, 1990

Related U.S. Application Data

[62] Division of Ser. No. 235,077, Aug. 23, 1988, Pat. No. 4,929,255.

[30] Foreign Application Priority Data

Aug. 28, 1987 [FI] Finland ..... 873735

[51] Int. Cl.[5] ..... C10J 3/56

[52] U.S. Cl. ..... 48/62 R; 48/63; 48/77; 110/245; 122/4 D

[58] Field of Search ..... 48/197 R, 202, 203, 48/206, 210, DIG. 4, 62 R, 63, 77, 64; 110/347, 245, 216; 122/4 D; 252/573

[56] References Cited

U.S. PATENT DOCUMENTS

| | | | |
|---|---|---|---|
| 2,700,599 | 1/1955 | Kalbach | 48/197 R |
| 3,847,566 | 11/1974 | Wilson | 48/202 |
| 3,867,110 | 2/1975 | Schora et al. | 48/206 |
| 3,884,649 | 5/1975 | Matthews | 48/202 |
| 3,932,146 | 1/1976 | Wilson et al. | 48/40 |
| 4,072,130 | 2/1978 | Zenz | 122/4 D |
| 4,103,646 | 8/1978 | Yerushalmi et al. | 122/4 D |
| 4,165,717 | 8/1929 | Reh et al. | 122/4 D |
| 4,315,758 | 2/1982 | Patel et al. | 48/202 |
| 4,400,181 | 8/1983 | Snell et al. | 48/206 |
| 4,424,766 | 1/1984 | Boyle | 122/4 D |
| 4,441,892 | 4/1984 | Schuster | 48/206 |
| 4,579,070 | 4/1986 | Lin et al. | 122/4 D |
| 4,672,918 | 6/1987 | Engstrom | 110/245 |
| 4,676,177 | 6/1987 | Engstrom | 110/245 |
| 4,684,375 | 8/1987 | Morin et al. | 48/206 |
| 4,741,290 | 5/1988 | Krieger | 122/4 D |
| 4,843,981 | 7/1989 | Goldbach et al. | 110/245 |

FOREIGN PATENT DOCUMENTS 2556983 3/1985 France .

*Primary Examiner*—Peter Kratz

*Attorney, Agent, or Firm*—Nixon & Vanderhye

[57] ABSTRACT

A method and apparatus for gasifying or combusting solid, carbonaceous material a circulating fluidized bed reactor. Particles are separated from the product gas at least in two stages so that in the first stage, mainly coarser, so-called circulating particles are separated and returned to the reactor. In the second stage, fine carbonaceous particulates are separated from the gas and are made to agglomerate at a raised temperature. Coarser particles thus received are returned to the reactor through a return duct together with circulating particles. Adhesion of agglomerating particles to the walls of the duct is prevented preferably by leading hot particulates to the center of the duct and circulating particles to the walls of the duct.

17 Claims, 3 Drawing Sheets

APPARATUS FOR GASIFYING OR COMBUSTING SOLID CARBONACEOUS

This is a division of application Ser. No. 07/235,077, filed Aug. 23, 1988now U.S. Pat. No. 4,929,255.

The present invention relates to a method of gasifying or combusting a solid carbonaceous material into a gaseous material in a circulating fluidized bed reactor. In the fluidized bed reactor, the flow rate of gas in the reactor chamber is maintained at such a high level that a considerable amount of solid particles is discharged with gas from the reactor chamber to a particle separator disposed after the reactor chamber, and the major part of these solid particles, i.e. the circulating material is separated in the particle separator and returned to the reactor chamber, and the gases are conveyed from the particle separator further to a gas purification stage, in which stage fine particulates are separated from the gas.

The invention also relates to an apparatus by means of which solid carbonaceous material is gasified or combusted and which comprises a circulating fluidized bed reactor provided, after a reactor chamber, with at least one separator for circulating particles, said separator being connected with a particle return duct for conducting separated particles back into the reactor chamber, preferably into its lower part.

Several different methods are employed for gasifying carbonaceous solid fuel, the most important of them being various gasifiers based on the fluidized bed concept. The problem with all gasification means, as also partly with fluidized bed gasifiers, is how to achieve a very high carbon conversion. This problem is particularly significant when fuels with low reactivity, such as coal, are to be gasified It is also difficult to achieve a high carbon conversion with fuels having a small particle size, such as milled peat.

Poor carbon conversion is principally the result of the comparatively low reaction temperature of fluidized bed gasifiers, which is restricted by the melting temperature of the fuel ashes. Carbon conversion can be significantly improved by increasing the reaction time of the gasification, i.e. by returning the escaped, unreacted fuel to the reactor.

In a circulating fluidized bed gasifier or boiler, the rate of flow of the upwardly directed flow of gas is so high that a substantial amount of solid bed material, entrained with product or flue gases, passes out of the reactor. Most of such outflowing bed material is separated from the gas by separators and returned to the reactor. The finest fraction, however, is discharged with gas. Circulating material in the reactor comprises ashes, coke and other solid material, such as limestone, possibly introduced in the gasifier, which induces desired reactions such as sulfur capture.

However, separators such as cyclones, which are normally used, have a restricted capacity for separating small particles. Normally hot cyclones can separate only particles up to the size of 50–100 μm, and finer fractions tend to escape with the gases. Since the unreacted fuel discharged from the reactor with the gas is mainly coke, from which the volatile (reactive) parts have already been discharged, it would, when returned to the reactor, require a longer retention time than the actual "fresh" fuel. Since the grain size of the returned coke is very small, the returned fine fraction is, however, immediately discharged again from the reactor chamber and thus the reaction time remains too short and the carbon conversion too low.

Even though small coke particles can be separated from the gases with new ceramic filters, new problems arise. Solid fuels always contain ashes which have to be removed from the system when pure gas is produced. When aiming at an as high carbon conversion as possible, ashes have to be removed so as to avoid discharging large amounts of unreacted carbon with the ashes. The particle size of the ashes, however, always varies within a wide range and fine ashes tend to fly out of the reactor with the fine coke residue.

In order to achieve a high carbon conversion, the following diverse problem has to be solved:

1. Separation of also fine particulates from the gases and return of such to the reactor must be possible, and
2. the carbon contained in the returned particulates has to be made to react and the ashes have to be separated from the system.

Until now, attempts to solve the problem have been unsuccessful.

It is also common in boiler plants, at fluidizing bed combustion, that unburnt coal is easily entrained with the fly ash, especially if poorly reactive fuel is employed or if the boiler plant is under a small load or under an extremely heavy load. Fly ash may contain over 10% of coal, sometimes even 20%, which deteriorates the efficiency of the boiler. As known, returning of the fly ash to the combustion chamber would give a lower carbon content in the fly ash, thus improving the efficiency of the boiler.

Fly ash itself is a problematic product. For example, in the U.S.A., only 20% of the total amount of fly ash can be utilized in the building industry and construction of roads. Final storing causes problems to the power plants. Fly ash is a fairly light material in volume weight, which means that the residual fly ash requires quite a large storage area.

This constitutes a problem in densely populated areas. Furthermore, one has to pay attention to storing of the ashes in such a manner that they do not come into contact with groundwater. Ammonia has been introduced lately into the purification of flue gases and this has added to the fly ash problem. The fly ash treated with ammonia is not applicable to the concrete industry.

The combustion temperatures in the fluidized bed boilers are substantially lower than, for example, in pulverized combustors and the ash properties are quite different. Ashes produced by combustion at lower temperatures are not stabile, but depending on the conditions, there may be gaseous, liquid or dusty emissions.

Finnish Patent Publication No. FI 66425 discloses a method and apparatus for solving the problem with the fines recycling. According to this method, the finest particulates separated from the gas are conducted back to the lower part of the reactor so that oxygenous gas is introduced in the same place in the reactor, thereby forming a high temperature zone in which the recovered fine particulates agglomerate with the particles in the fluidized bed. This method introduces an improvement in the so called "U-gas Process" method.

British Patent No. GB 2065162 discloses a method and apparatus for feeding the fine material separated from gas to the upper part of the fluidized bed in which the fine particulates agglomerate with particles of the fluidized bed when oxygenous gas is conducted to the same place in the reactor.

The problem with both of these methods is clearly the process control. Both methods aim at agglomeration of the separated fine material to the fluidized bed featuring excellent heat and material transfer properties. It is of major importance that the main process itself can operate at an optimal temperature, and it is easily disturbed when the temperature needed for the agglomeration is not the same as that needed for the main process. Due to the good heat transfer in the fluidized bed, the temperatures tend to become balanced, which causes new problems. Gas different from the oxygenous gas used in the actual gasification is needed because of the excess heat. Additionally, because the size of particles contained in the fluidized bed varies considerably, it is difficult to control the agglomeration in the reactor so that production of ash agglomerates of too large a size could be prevented. Ashes stick to large as well as small bed particles and ash agglomerates of too large a size are easily formed, which impede or prevent ash removal and the gasifying process has consequently to be interrupted. Furthermore, agglomeration in the reactor itself causes local overheating, which in turn leads to abrasion of refractories.

U.S. Pat. No. 3,847,566 discloses one solution in which high carbon conversion is sought by burning the fine material escaping from the gasifier in a separate combustion device. Coarser, carbonaceous material taken from the fluidized bed is heated with the heat released from combustion. This carbonaceous material is returned to the fluidized bed after the heating. This is how the heat required for the gasification is generated. The gases, flue gas and product gas, released from the combustion and gasification have to be removed from the system in two separate processes both including a separate gas purification system. As can be seen, the arrangements of this method require quite complicated constructions and result in the process control becoming difficult.

The problem with the above-mentioned methods resides in the difficult process conditions where agglomeration conditions have to be controlled. This calls for expensive materials and cooled constructions.

The object of this invention is to provide a method and apparatus for gasification or combustion, by means of which the highest possible carbon conversion is attained without the above-mentioned drawbacks in the process control and without complicated and expensive constructions. The purpose of the invention is also to separate, as well as possible, the finest carbonaceous particulates from the product or flue gas and return them to the reactor in such a form that the carbon contained in the particulates can be exploited and the ashes be separated in the process.

According to the invention the method of gasification is characterized in that fine particulates separated at the gas purification stage are agglomerated to the circulating material at a raised temperature prior to returning the particles to the reactor chamber. In other words, particles are separated from the produced gas at least in two stages. In the first stage, mainly coarser particles are separated and are mostly returned to the circulating fluidized bed reactor, and in the second stage mainly finer, carbonaceous particulates are separated, at least part of which is returned to the fluidized bed reactor after being agglomerated to and mixed with the circulating particles at a raised temperature.

The temperature of the separated fine particulates is preferably raised to over 1000° C., most preferably to 1100°-1300° C., by conducting oxygenous gas into the flow of particulates, whereupon at least part of the fine particulates form or become sticky particles which are caused to agglomerate with the circulating particles before they are returned to the reactor chamber. Preferably, agglomerated particles are caused to mix evenly with the circulating particles before they are returned to the reactor.

According to the invention, the circulating fluidized bed reactor for realizing the method mentioned above is characterized in that, subsequent to the separator for circulating particles, the product gas flow is provided with at least one separator for fine particulates, which separator is connected with a flow duct to an agglomerating means, which is disposed in contact with the return duct for circulating particles.

In such processes where the higher the temperature for purification of the gas the better, fine particulates can also be separated from the product gas by employing several consecutively connected cyclones, cyclone radiators or high-heat filters or other equivalent means which are also capable of separating fine particulates.

On the other hand, for example, connected with a combined power plant, it is advantageous to use the hot product gas for superheating steam and not to separate the fine particulates from the product gas until the gas has cooled to a lower temperature, such as 850° C. In this case, the purification of the gas is also easier to accomplish. At a lower temperature, the gas does not include to a harmful extent fine fumes which are difficult to separate and which easily clog, for example, pores of ceramic filters. Furthermore, hot fumes are chemically extremely aggressive and impose great demands on materials. The method according to the present invention is therefore most suitable for combination power plant applications because the carbon conversion of the fuel is high, the product gas is pure and well applicable to gas turbines and, furthermore, the overall heat economy is improved by superheating of the steam.

Agglomeration increases the grain size of fine particulates to such an extent that the retention time of the particulates becomes longer in the reactor and the carbon conversion is improved. If the grain size of the returned particulates is increased sufficiently, the ash particles can be removed from the reactor at an optimal stage, whereby the carbon contained in ash grains has reacted almost completely.

By agglomerating the particulates outside the actual fluidized bed reactor, where the coarsest circulating particles are considerably smaller in size than the coarsest fluidizing particles in the reactor itself, formation of particles of too large a size is avoided, which particles might be discharged from the reactor along with the ashes thereby leaving the carbon insufficient time to react completely.

Gasification in a circulating fluidized bed reactor is in some ways different from gasification in a conventional bubbling fluidized bed reactor. In a circulating fluidized bed reactor, the upwardly directed flow rate is so high, typically 2-10 m/s, that a large amount of solid bed material is raised along with the gases to the upper part of the reactor and further out of the reactor, where it is returned after the gas separation. In such reactor, the important reactions between the gases and solid material are effected over the entire area of the reactor while the suspension density is even in the upper part of the reactor 0.5-30 kg/kg of gas, most commonly 2-10 kg/kg of gas.

In a bubbling fluidized bed, where the flow rate of the gas is typically 0.4–2 m/s and the suspension densities in the upper part of the reactor about 10 to 100 times lower than in the circulating fluidized bed reactor, the gas/-solid material reactions are mainly effected in the lower part of the reactor i.e. in the bed.

The method of the invention has, for example, the following advantages:

- A high degree of carbon conversion is achieved by the method.
- Agglomeration of fine carbon can be effected in a controlled manner not disturbing the process conditions in the gasifier or boiler.
- With a circulating fluidized bed concept, the cross section of the reactor can be clearly smaller than with a so-called bubbling fluidized bed reactor.
- Thanks to the smaller cross section and better mixing conditions, there is an essential decrease in the need for fuel feed and ash removal devices in comparison with the so-called bubbling bed.
- Capture of sulfur contained in the fuel with inexpensive lime can be effected in the process.
- Reactions between solids and gases take place over the entire area of the reactor section and separator.
- The equipment described above does not require expensive special materials.
- As the various stages of the process are performed in various devices, the process control can be carried out optimally with regard to the total result.
- Inert ashes are received
- Problems with storing fly ash are reduced.

The invention will be further described below, by way of example, with reference to the accompanying drawings, in which two embodiments of the present invention are illustrated as follows.

Figure 1:
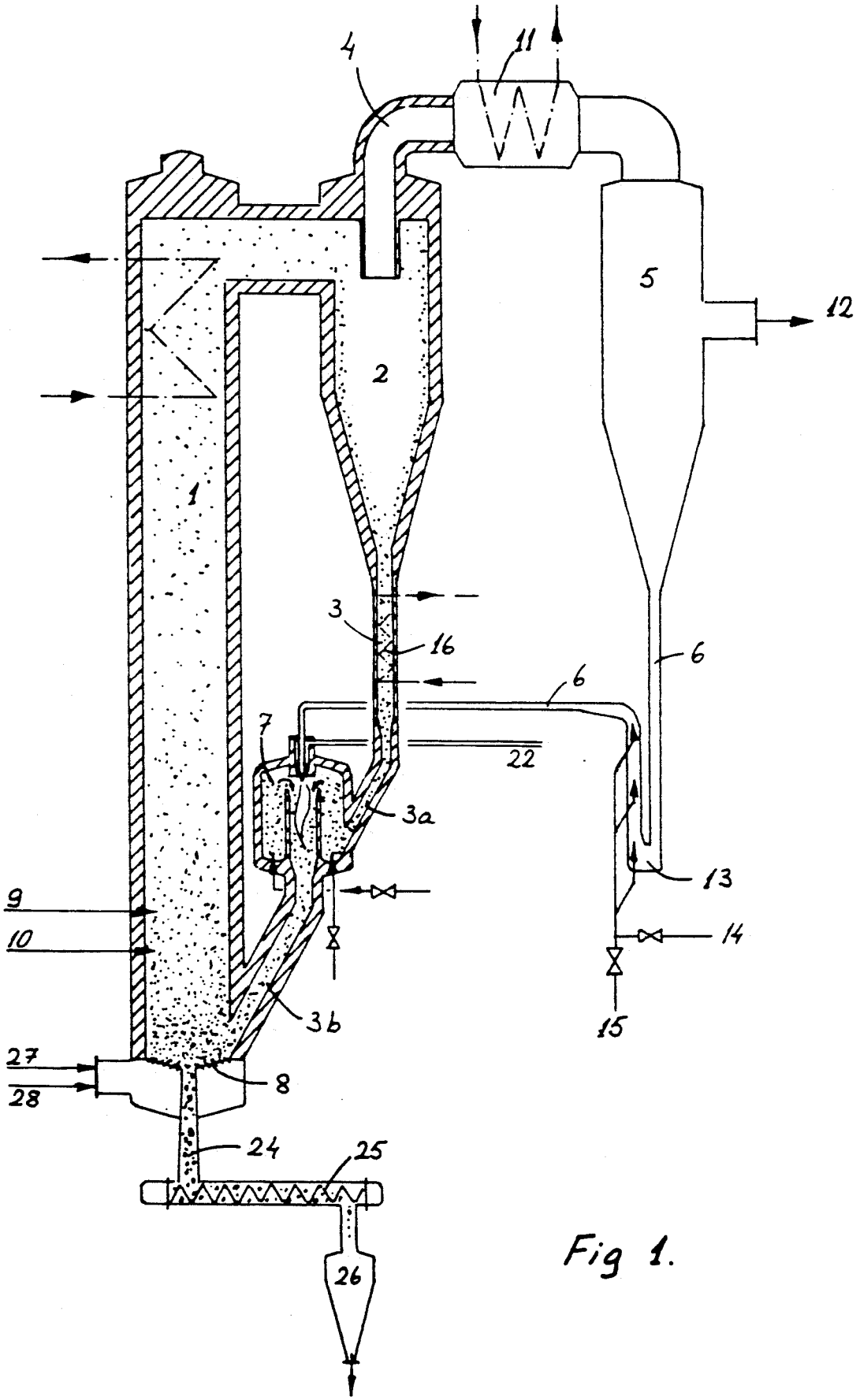
FIG. 1 is a schematic illustration of a gasifier.

In a gasifier shown in FIG. 1, the upper part of a fluidized bed reactor 1 is connected to a particle separator 2, the lower part of which is provided with a return duct 3 which conducts circulating particles to the lower part of the reactor. The product gas is discharged from the upper part of the separator through a discharge duct 4 to a separator 5 for removing fine particulates. The separator 5 for fine particulates is provided with a duct 6 which leads fine particulates to a sealing and agglomerating means 7, which is disposed connected with the return duct 3 for circulating particles. The bottom of the fluidized bed reactor 1 is provided with a distributor 8 for fluidizing gas. Carbonaceous solid material to be gasified is introduced in the reactor through a conduit 9 and lime or other material intended to separate sulfur contained in the material to be gasified through a conduit 10. In accordance with the invention, the major part of the solids issuing from the reactor 1 and comprising unreacted carbon and solid material, such as lime and ashes contained the fuel, possibly fed into the reactor through conduit 10, is separated from the gas in the separator 2. However, the finest fraction, the ratio of which is typically 0.1–2% of the solids flowing from the reactor, passes with the product gas flow discharged from the reactor. The separator 2 may be of some known type, such as a cyclone separator with refractory lining or some other equivalent hot gas separator.

A high temperature of 750° to 1100° C. typically prevails in the reactor 1 and separator 2. The reactor 1 and separator 2 are preferably internally lined with refractory brick or the like. Hot gases together with the small amount of fine particulates contained therein may be led through duct 4 to a heat recovery unit 11, if required, which unit also cools the gases to some extent.

Subsequent to the heat recovery unit 11, the gases are led to a further separator 5 for fine particulates, where practically all solids are separated from the gases. The separator 5 may be of known type, such as a ceramic or other filter, or a centrifugal separator with a high separating capacity. Pure gas passes through duct 12 to the point of use. Fine particulates, which have been separated from the gas in separator 5, pass through duct 6 to the sealing and agglomerating means 7. When the fine particulate material, having been separated in the separator 5 and containing carbon dust, is hot, it is preferable to use a loop seal 13 in order to feed particulates to the agglomerating means 7 by using oxygenous gas fed in through a duct 14. This causes partial oxidation of the particulates conveyed in the duct 6, thus raising the temperature of said particulates. If the particulates tend to become over-heated, it is possible to also feed other gas through a duct 15. Preferred other gases are aqueous steam and carbon dioxide. If necessary, conveyance of particulates can be effected by an inert gas only.

A great mass flow of solids coming from the separator 2 and passing through the duct 3 to the lower part of the sealing and agglomerating device 7 may, if necessary, be cooled by a cooler 16 disposed in the duct 3, thus also recovering heat. A circulating flow of coarse particles shall be cooled if the flow of fine particulates to be heated is great in proportion to the circulating particle flow, thus having a heating effect on the reactor. Usually, the flow of fine particulate material is very small in proportion to the circulating particle flow, thus having no effect on the temperature of the reactor.

Figure 2:
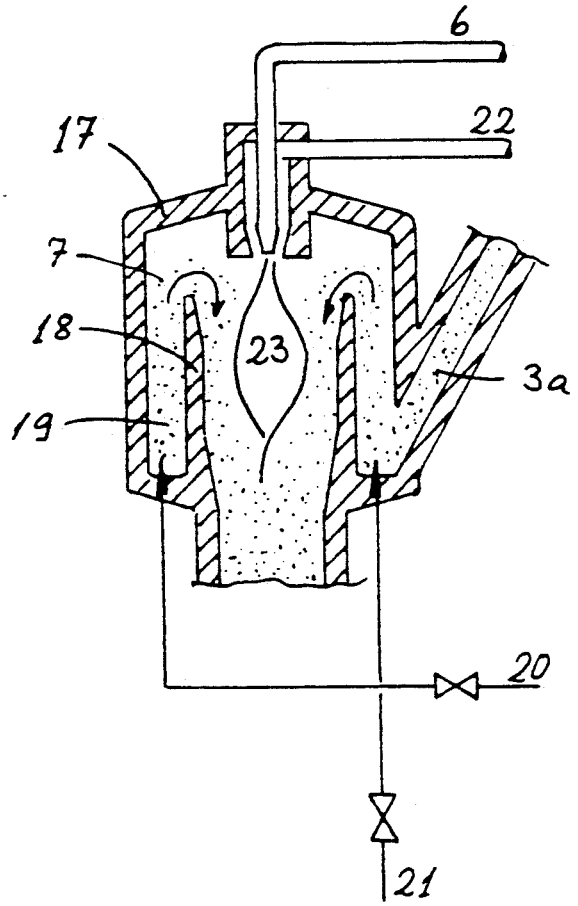
FIG. 2 is a schematic illustration of a sealing and agglomerating device.

The sealing and agglomerating means illustrated in FIG. 2 comprises a cylindrical vessel 17, inside of which there is a centrally disposed, vertical, refractory duct 18 communicating with the lower part of the reactor 1 through a duct **3*b*. A great particle flow issuing from the duct 3*a* is led to a space 19 between the vessel 17 and the central duct 18 therein. The bottom of this intermediate space is supplied with fluidizing gas suitable for the flow of solid particles issuing from the duct 3*a*. Said fluidizing gas may be oxygenous gas, fed through a duct 20, preferably by blower members, and/or, if the temperature of the particle flow so requires, other gas, preferably aqueous steam or carton dioxide, may be fed through a duct 21**.

A fluidizing barrier layer is thereby formed between the duct 18 and the vessel 17 to prevent the flow of gases from the reactor 1 through ducts **3*b* and 3*a* to the separator 2 and to overflow the particles issuing from the duct 3*a* to the duct 18 and further through duct 3*b* to the reactor 1**.

The fine particulates passing through the duct 6 as well as oxygenous gas blown through the duct 22 are blown to the upper end of the duct 18 disposed centrally in the vessel 17. A hot zone 23 greater than 1000° C. is thereby created in the middle of the flow of particulate material moving in the duct 18, in which zone the fine ash particles partly melt and adhere to each other or to circulating particles, thus forming coarser grains. The downwardly directed flow of particulates about the walls of the duct 18 protects the internal walls of the duct from the sticky particles present in the middle of the flow of particulates. Since the flow of particulates discharged from the separator 5 is generally substantially smaller than the flow of particles from the separator 2, it is possible to arrange the agglomeration of fine particulates to the main flow of particles in a controlled manner without impeding the gasifying process itself taking place in the reactor. When entering the reactor, the flows of fine particulates and other particles have mixed in the duct 3*b* and the temperatures have become balanced. Since the grain size of the particles discharged from the separator 2 is known (typically 99% less than 1 mm) as well as the particulates discharged from the separator 5 (typically 99% less than 0.1 mm), it is easy to control the agglomeration so as to form bigger grains of the size less than 10 mm.

The material from the duct 3*b* enters the reactor, above the distributor 8 of the fluidizing gas, said distributor being disposed at the bottom of the reactor in an oxygenous atmosphere. Here the slightly reactive agglomerated coke particles reach, because of their increased size of grains, a sufficient retention time in order to react completely, whereby the material being discharged through an ash discharge duct 24 contains a very small amount of unreacted carbon. Ash removal from the reactor is controlled by a control means 25, which may be, for example, a screw conveyor and the ashes are taken to an ash treating means 26, which may be of some earlier known type.

The oxygenous gas is led through a duct 27 underneath the distributor 8 of the fluidizing gas, which distributes the gas to the reactor. Besides oxygenous gas, it is preferable to feed aqueous steam as a fluidizing gas through a duct 28, especially when gasifying coal.

The solid material to be gasified is fed into the reactor through the conduit 9 preferably so that the feeding point is disposed above a denser fluidizing layer at the bottom of the reactor where the volatilizing substances of the fuel are partly released, thus producing gas with a high calorific value. Solid material is preferably fed to a level between 2 m and 4 m above the distributor of oxygenous gas to be fed into the reactor.

Figure 3:
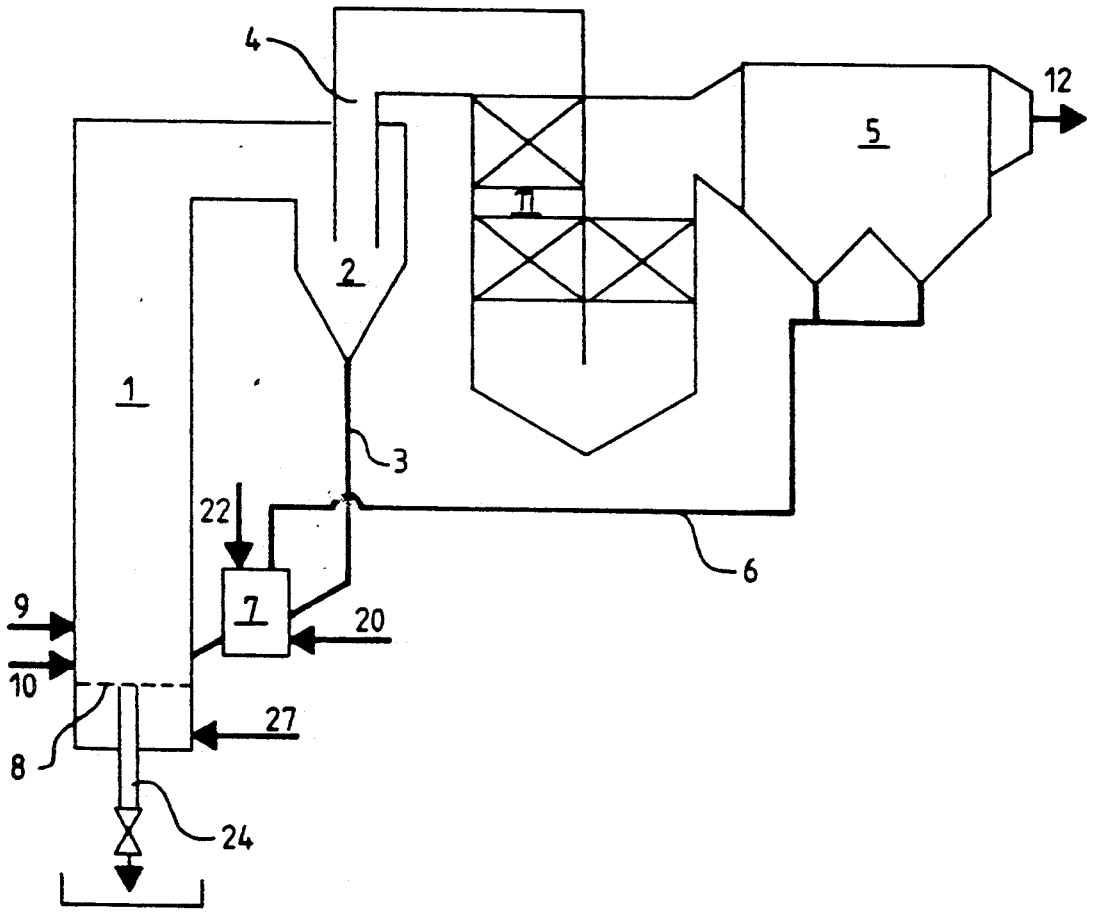
FIG. 3 is a schematic illustration of a boiler plant.

In the boiler plant shown in FIG. 3, the application is applied to treatment of fly ash in a circulating fluidized bed boiler employing fossile fuels. The fluidized bed boiler 1 is connected with a particle separator 2 and a return duct 3 for circulating material. The gas purified of circulating particles is led through a conduit 4 to a convection part 11 and further to a gas purifying means 5 which may be, for example, an electric filter, bag filter, ceramic filter, multi-cyclone or some other equivalent separator for fine particulate material.

Fine particulates are conveyed from the gas purifying means through a duct 6 to an agglomerating means 7 disposed in the return duct 13 for the circulating particles. The agglomerating means operates as described above. The temperature is raised to over 1000° C., preferably to 1100°–1300° C., by means of oxygenous gas, preferably air, from duct 22, at which temperature at least part of the fly ash melts and adheres to the circulating particles. The agglomerating means may be supplied with extra fuel from duct 20 if the carbon content of the fine particulates is insufficient for raising the temperature to the desired level. The extra fuel may be fuel to be combusted in the boiler. In some applications, all fuel may be introduced in the boiler through the agglomerating means and the temperature in the agglomerating means be regulated by the amount of oxygenous gas.

Because the amount of fine particulates is essentially smaller than the flow of circulating particles and because generally the temperature of only fine particulates may be raised in the agglomerating means, a controlled recycling of particulates is possible without impeding the actual combustion process. Agglomeration of the fine particulates to the circulating particles outside the boiler facilitates the choice of the agglomerating temperature in accordance with the ashes yet having no harmful effect on the process in the boiler, whereas the temperature of the boiler can rarely be adjusted to suit the agglomeration to be effected in the boiler itself without impeding the combustion process.

When being mixed with cooler circulating particles, molten fly ash solidifies and forms hard and dense particles coarser than the circulating particles, typically 2 mm to 20 mm in size. Coarse ash grains thus received are passed along with the re-circulation to the combustion chamber of the boiler, wherefrom they can be separated and discharged together with normal settled ashes through ash discharge duct 24.

In some applications, it is preferable to pressurize the circulating fluidized bed reactor under a gas pressure of 1 to 50 bar, whereby a reactor small in size is capable of producing gas suitable for, for example, combination power plant processes.

The invention is not intended to be limited to the gasifier or boiler plant described in the above examples. In some applications, it may be preferable to provide the reactor with several particle separators disposed either adjacently or in series and dispose an agglomerating means in only one or in all return ducts. The fine particulates can also be separated in several separators, which may be of different types. It is possible to agglomerate fine particulates separately from the return duct and mix only the circulating particles and agglomerated particulates in said duct. The lower part of the return duct 3*b* can also be provided with heat recovery equipment. Adhesion of agglomerating particles to the walls of the return duct can be prevented by leading gas flows along the duct walls so as to cool the particles until they touch the walls.

The invention is naturally also applicable to such gasifying reactors that do not employ oxygenous gas to bring about gasification but the temperature of the fuel in them is raised in some other way.

We claim:

1. An apparatus for gasifying or combusting a solid carbonaceous material comprising:

a circulating fluidized bed reactor including a reactor chamber;

at least one first separator for separating circulating particles, disposed after said reactor chamber, and connected to the reactor chamber with a return duct for recirculating separated particles to the reactor chamber;

means defining an outlet for discharging gas from a first separator;

a second separator connected in said outlet for discharging gas from a first separator, said second separator for separating fine particles and having a discharge duct for the fine particles extending therefrom; and agglomerating means connected to said discharge duct for fine particles and to said return duct for circulating particles, said agglomerating means for agglomerating fine particles separated by said second separator with particles separated by a first separator.

2. Apparatus as recited in claim 1 wherein said at least one first separator comprises a single cyclone separator.

3. Apparatus as recited in claim 1 wherein said second separator is a cyclone separator.

4. Apparatus as recited in claim 1 wherein said second separator is an electric filter.

5. Apparatus as recited in claim 1 wherein said second separator is a ceramic filter.

6. Apparatus as recited in claim 1 wherein said agglomerating means comprises: a vessel a vertical open duct disposed centrally in the vessel and spaced a predetermined distance from the upper part thereof, and a lower part of the vertical open duct connected to a lower part of said particle return duct leading to said reactor chamber; means defining a cylindrical space between the walls of the vessel and the vertical duct, said space being in contact with an upper part of said particle return duct from the first separator; gas inlet ducts disposed in the lower part of said cylindrical space, for conveying circulating particles from said cylindrical space into said vertical duct over the upper edges of said duct, and to said return duct leading to said reactor chamber; and an inlet duct for fine particles from said second separator, said inlet duct disposed above the middle of said vertical duct in the upper part of said vessel; and an inlet duct for oxygen containing gas disposed in operative connection with said inlet duct for fine particles.

7. Apparatus as recited in claim 6 further comprising means for positively cooling the gas between said first and second separators.

8. Apparatus as recited in claim 6 further comprising means for removing ash from the bottom of said reactor chamber.

9. Apparatus as recited in claim 6 wherein said second separator is a cyclone separator.

10. Apparatus as recited in claim 6 wherein said second separator is an electric filter.

11. Apparatus as recited in claim 6 wherein said second separator is a ceramic filter.

12. Apparatus as recited in claim 6 wherein said at least one first separator comprises a single cyclone separator.

13. Apparatus as recited in claim 1 wherein said agglomerating means includes means for preventing adhesion of hot, agglomerating fine particles to the walls of said return duct by leading said fine particles to the center of the return duct, and circulating other particles from a first separator along the walls inside the return duct.

14. Apparatus as recited in claim 13 wherein said agglomerating means further comprises means for intimately mixing together particles separated in said first and second separators to provide a uniform distribution of both types of particles.

15. Apparatus as recited in claim 1 further comprising means for positively cooling the gas between said first and second separators.

16. Apparatus as recited in claim 15 wherein said agglomerating means includes means for preventing adhesion of hot, agglomerating fine particles to the walls of said return duct by leading said fine particles to the center of the return duct, and circulating other particles from a first separator along the walls inside the return duct.

17. Apparatus as recited in claim 16 further comprising means for removing ash from the bottom of said reactor chamber.

* * * * *